United States Patent [19]

Merkert

[11] 4,353,744

[45] Oct. 12, 1982

[54] PROCESS FOR PRODUCING A VANADIUM SILICON ALLOY

[75] Inventor: Rodney F. Merkert, Buffalo, N.Y.

[73] Assignee: Union Carbide Corporation, Danbury, Conn.

[21] Appl. No.: 278,960

[22] Filed: Jun. 30, 1981

[51] Int. Cl.[3] ..... C22B 34/22

[52] U.S. Cl. ..... 75/134 V; 75/0.5 BB; 75/84

[58] Field of Search ..... 75/134 V, 129, 0.5 BB, 75/84; 423/62, 344

[56] References Cited

U.S. PATENT DOCUMENTS

| | | | |
|---|---|---|---|
| 825,325 | 6/1907 | Becket | 238/336 |
| 858,328 | 6/1907 | Becket | 75/84 |
| 876,313 | 1/1908 | Becket | 75/84 |
| 1,715,867 | 2/1928 | Saklatwalla | 75/134 V |
| 1,727,180 | 9/1929 | Saklatwalla | 75/134 V |
| 2,481,599 | 9/1949 | Kinzel et al. | 75/27 |
| 2,576,763 | 11/1951 | Linz | 75/133 |
| 3,256,087 | 6/1966 | Frostberg et al. | 75/122 |
| 3,262,776 | 7/1966 | Loeffler | 75/123 |
| 3,334,992 | 8/1967 | Downing et al. | 75/0.5 |
| 3,420,659 | 1/1969 | Rathmann et al. | 75/84 |
| 3,565,610 | 2/1971 | Retelsdorf et al. | 75/133 |
| 3,591,367 | 7/1971 | Perfect | 75/133 |
| 3,623,862 | 11/1971 | Spengler, Jr. et al. | 75/57 |
| 3,635,700 | 1/1972 | Wincierz et al. | 75/134 |
| 3,979,500 | 9/1976 | Sheppard et al. | 423/289 |
| 4,165,234 | 8/1979 | Kostyanoi | 75/60 |
| 4,167,409 | 9/1979 | Downing et al. | 75/129 |

FOREIGN PATENT DOCUMENTS

| | | | |
|---|---|---|---|
| 1272263 | 9/1967 | Fed. Rep. of Germany | 75/110 |
| 197712 | 6/1967 | U.S.S.R. . | |

*Primary Examiner*—L. Dewayne Rutledge
*Assistant Examiner*—Christopher W. Brody
*Attorney, Agent, or Firm*—John R. Doherty

[57] ABSTRACT

A vanadium-silicon alloy having a low carbon and oxygen content is produced by vacuum furnacing a mixture of $V_2O_3$, carbon and silicon metal in at least the stoichiometric amounts necessary to reduce $V_2O_3$ and form $V_2Si$ while preventing vanadium from combining with carbon and oxygen.

1 Claim, No Drawings

PROCESS FOR PRODUCING A VANADIUM SILICON ALLOY

The present invention relates to a process for producing a vanadium silicon alloy. More particularly, the present invention relates to a process for producing a vanadium silicon alloy which is relatively low in both carbon and oxygen.

It is desirable to employ a low carbon vanadium alloy in the production of high quality pipeline steels. The composition of these steels should be substantially free of carbon in order to maintain good welding characteristics.

There are a number of known processes for producing various low carbon vanadium alloys. Unfortunately, these processes have not proven altogether satisfactory primarily because they are neither efficient or economical. For instance, low carbon ferrovanadium alloys can be made by aluminum reduction but these processes are not very economical due to the high cost of aluminum. Since silicon is a required additive in most steels, a low carbon silicon vanadium alloy would be ideal for use in the production of pipeline steels if the alloy could be made at a reasonable cost.

U.S. Pat. No. 4,167,409 issued to J. H. Downing and R. F. Merkert on Sep. 11, 1979, discloses a process for producing a low sulfur vanadium-carbon material by the vacuum furnacing of a mixture of vanadium oxide ($V_2O_3$), finely divided carbon and a minor proportion of at least one material selected from the group consisting of silicon, silica and tin. This mixture is compacted into briquets and then subjected to temperatures in a range of from about 1200° C. to 1400° C. in a vacuum furnace. The pressure inside the furnace is maintained at about 300 microns, for example. It has been found that in order to produce a vanadium-carbon material containing less than about 0.05% by weight sulfur, the selected additive should be employed in certain specific amounts. When the additive is silicon or silica, for example, it can be used in amounts of about 1 to 9 times the weight of sulfur in the carbon constituent of the mixture. The product that is formed under these conditions with minimal amounts of silicon, silica or tin is essentially combined vanadium and carbon, i.e., at least about 80% by weight with the predominent portion of combined vanadium being in the form of $V_2C$.

It is an object of the present invention to provide an improved process for making a vanadium silicon alloy which is useful in the production of low carbon steels such as pipeline steels. Another object of the present invention is to provide such an improved process for producing a vanadium silicon alloy which is low in carbon and oxygen.

Other objects and advantages will become apparent from the following description:

In accordance with the present invention, there is provided an improved process for making a low carbon vanadium silicon alloy which is basically similar to the above described process for producing vanadium-carbon materials having a low sulfur content but wherein a significantly increased amount of silicon is employed. The silicon metal combines with vanadium upon reduction of the $V_2O_3$ and forms a silicide while at the same time preventing vanadium from combining with carbon and oxygen. Generally, the amounts of finely divided carbon and silicon to be used in the mixture should be sufficient to carry out the following reaction:

$$V_2O_3+3C+Si \rightarrow V_2Si+3CO\uparrow$$

More specifically the present invention is directed to an improved process for producing a low carbon vanadium silicon alloy which comprises mixing together finely divided $V_2O_3$, carbon and silicon in proportional amounts which will effect reduction of the vanadium oxide and enable the vanadium to combine with the silicon to form a silicide, compacting the mixture into briquets and vacuum furnacing the mixture at elevated temperatures, e.g., 1200° C. to 1400° C. and at low pressures preferably between about 100 and 500 microns, and recovering the so formed low carbon vanadium silicon alloy.

The proportion of finely divided carbon and silicon used in the mixture is preferably the stoichiometric amount indicated by the above reaction. However, it has been found that the actual amount of carbon and silicon can be varied over a fairly wide range without seriously effecting the product. Generally, the mixture should contain for 100 parts by weight of $V_2O_3$ from about 18 to 30 parts by weight finely divided carbon and from 15 to 40 parts by weight finely divided silicon.

In the practice of the present invention, the finely divided carbon can be commercial lamp black carbon, e.g., Thermax. Similarly, the silicon metal can be any finely divided commercial grade of silicon such as Silicon Fines.

The following examples will serve to further illustrate the present invention.

EXAMPLE I

A mix was prepared containing 20 lbs. of $V_2O_3$ sized $-65$ mesh to $<5\mu$, 4.8 lbs. of fine carbon black, i.e., Therm(trademark of R. T. Vanderbilt Corp.), and 3.7 lbs. of Silicon fines sized $-200$ mesh. These ingredients were added to a lab. PK Blender where they were thoroughly mixed for about 20 min. and then transferred to a paint mixing machine and blended for another $\frac{1}{2}$ hour. The blended mixture was then placed in a 50 lbs. Simpson Muller along with 3,400 ml. of water. Briquets sized about $1\frac{1}{2}\times1\frac{1}{4}\times1$ inch were prepared from the wet mix by pressing at 3,000 psi and drying at 200° C. The individual weights of 5 sample raw briquets in grams were as follows: 49, 45.75, 46, 45 and 48 grams, respectively. The briquets had an average bulk density of about 55 pounds per cubic foot and an apparent density of about 2. The briquets weighing 8 lbs.-1 oz. were charged to a vacuum furnace having interior working dimensions of $13\times40$ inches. The furnace was heated to a temperature of 1000° C. and maintained at this temperature for about 1 hour while the furnace pressure was reduced to between 975 and 600 microns. The temperature of the furnace was then elevated to 1400° C. for about 12 hours and the pressure reduced to between 700 and 175 microns. The furnace was then allowed to cool to room temperature under a positive pressure of argon. The product briquets weighing a total of 5 lbs. were removed and analyzed. A typical analysis was as follows: 73.41% by weight vanadium, 18.98% by weight silicon, 1.77% by weight carbon and 3.4% by weight oxygen.

EXAMPLE 2

A mix was prepared containing 20 lbs. of $V_2O_3$ sized $-65$ mesh to $<5\mu$, 4.8 lbs. of fine carbon $<5\mu$, i.e., Thermax, and 7.5 lbs. of silicon fines sized 200 mesh.

The same procedure as outlined in Example I for blending the mixture was followed except that in this case 3,500 ml. of water was added to the mix in the Simpson Muller. Briquets of approximately the same size and weight were formed and charged to the vacuum furnace in amounts of approximately 7 lbs.-13 oz. The furnace was cycled using the same range of temperatures and pressures and the product briquets were removed and analyzed. The analysis yielded the following results: 64.38% by weight vanadium, 27.26% by weight silica, 4.44% by weight carbon, and 1.6% by weight oxygen.

What is claimed is:

1. A process for producing a vanadium-silicon alloy having a low carbon and oxygen content, which comprises: forming a mixture of finely-divided $V_2O_3$, carbon and silicon metal in at least the stoichiometric amounts necessary to reduce the $V_2O_3$ and form $V_2Si$ while simultaneously preventing the vanadium from combining with carbon and oxygen, and then heating the mixture to temperatures of between about 1200° C. and 1400° C. under a vacuum of between about 100 and 500 microns.

* * * * *

UNITED STATES PATENT AND TRADEMARK OFFICE

CERTIFICATE OF CORRECTION

PATENT NO. : 4,353,744

DATED : October 12, 1982

INVENTOR(S) : Rodney F. Merkert

It is certified that error appears in the above—identified patent and that said Letters Patent is hereby corrected as shown below:

Column 2, line 36, "Therm" should read -- Thermax C --.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*